United States Patent [19]

Hartkorn

[11] Patent Number: 4,488,324

[45] Date of Patent: Dec. 18, 1984

[54] MEANS FOR SPANNING THE JOINT BETWEEN ADJOINING STRUCTURAL MEMBERS OF A BRIDGE OR LIKE STRUCTURE

[76] Inventor: Alfred Hartkorn, Kolpingstr. 25, 8068 Pfaffenhofen/Ilm, Fed. Rep. of Germany

[21] Appl. No.: 359,879

[22] Filed: Mar. 19, 1982

[30] Foreign Application Priority Data

Apr. 24, 1981 [DE] Fed. Rep. of Germany ..... 3116429

[51] Int. Cl.[3] ..... E01D 19/06; E01C 11/10

[52] U.S. Cl. ..... 14/16.5; 404/65; 404/67; 52/403

[58] Field of Search ..... 404/68, 64, 65, 67, 404/47, 19; 14/16.5; 49/475, 489; 52/396, 403

[56] References Cited

U.S. PATENT DOCUMENTS

| | | | |
|---|---|---|---|
| 3,888,599 | 6/1975 | Reifsnyder | 52/396 X |
| 4,067,660 | 1/1978 | Puccio | 404/65 X |
| 4,282,620 | 8/1981 | Hartkorn | 404/68 X |
| 4,366,590 | 1/1983 | Huber et al. | 404/64 X |
| 4,367,976 | 1/1983 | Bowman | 404/64 X |

FOREIGN PATENT DOCUMENTS

| | | | |
|---|---|---|---|
| 724933 | 1/1966 | Canada | 49/475 |
| 2512048 | 9/1976 | Fed. Rep. of Germany | 14/16.5 |
| 2609759 | 9/1977 | Fed. Rep. of Germany . | |
| 2511278 | 12/1977 | Fed. Rep. of Germany . | |
| 2952613 | 1/1981 | Fed. Rep. of Germany . | |
| 586790 | 4/1977 | Switzerland | 404/64 |

*Primary Examiner*—James A. Leppink
*Assistant Examiner*—Beverly E. Hjorth

[57] ABSTRACT

Means for spanning the joint between adjoining structural members of a bridge or like structure which is of the kind consisting in a body which runs along the joint and can be flexed to engage a bead or thickening along each edge of the body in a corresponding recess or groove in the adjacent member. In the particular case of the invention the bead or thickening is associated with a tongue which engages behind an upstanding nose in the recess of groove to promote the fastening.

4 Claims, 6 Drawing Figures

FIG. 1
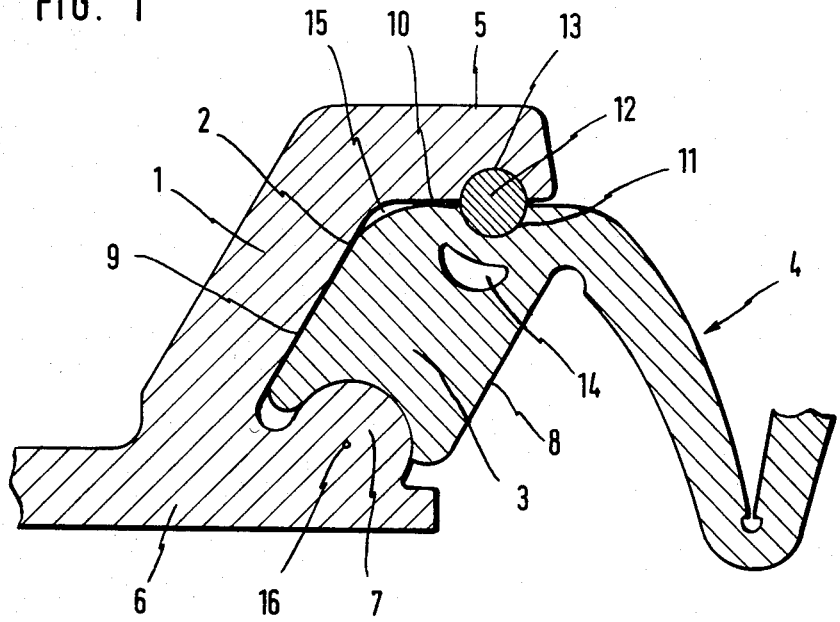
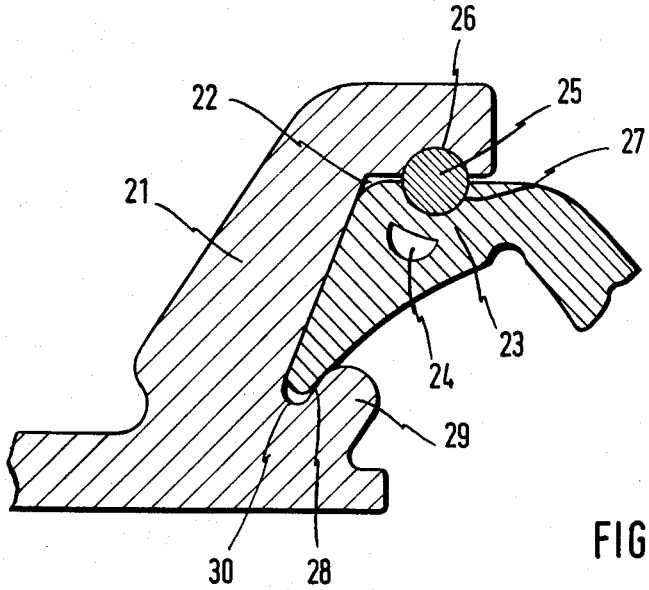
FIG. 2

FIG. 3
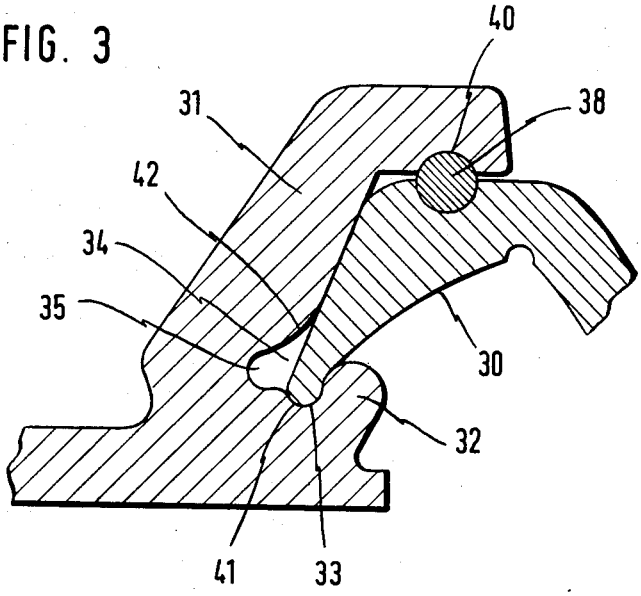
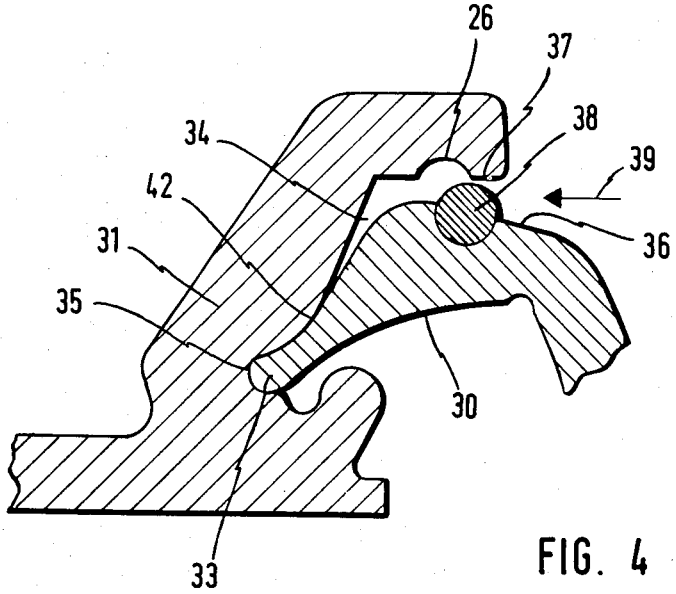
FIG. 4

FIG. 5
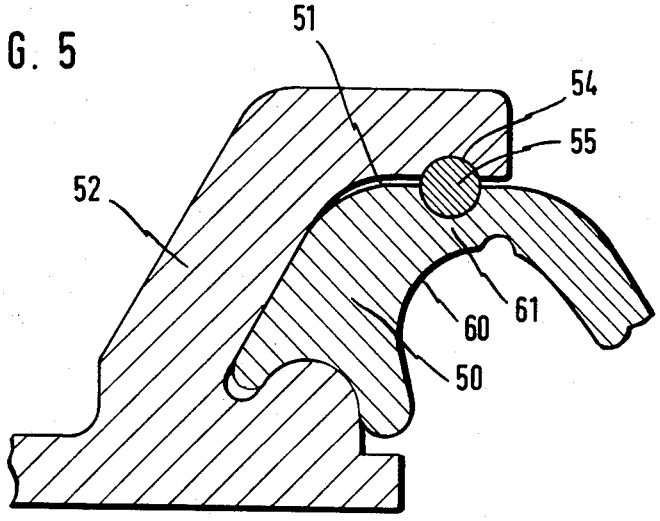
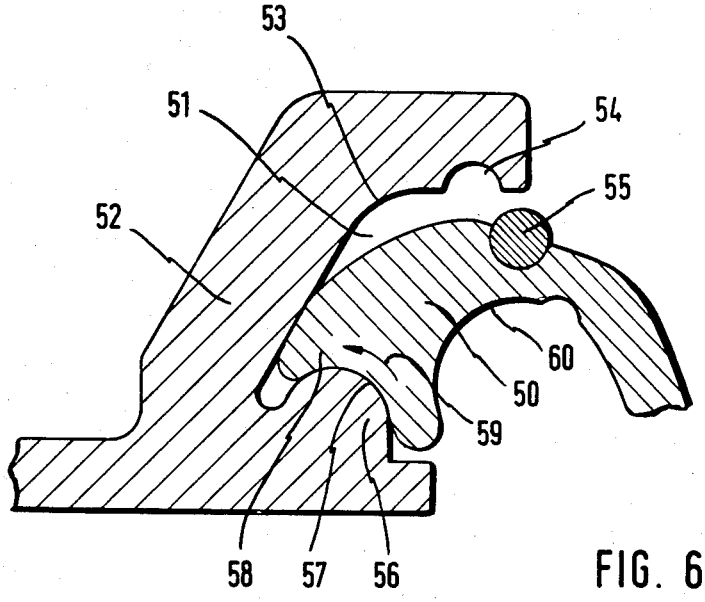
FIG. 6

MEANS FOR SPANNING THE JOINT BETWEEN ADJOINING STRUCTURAL MEMBERS OF A BRIDGE OR LIKE STRUCTURE

BACKGROUND OF THE INVENTION

This invention relates to bridges and like structures and in particular to means which are used to close and mask any division which may manifest itself between adjoining members of the structure.

More specifically the invention is concerned with a jointapanning means of this kind which comprises a resiliently collapsible gap-closing folded body having along each side edge thereof a bead portion for engagement in one of two confronting longitudinal recesses, one of each of said adjoining members, each of said bead portions having at its upper part a longitudinal groove of at least approximately circular cross-section matching a confronting groove of similar form in the corresponding said adjoining member, with a fastening key of appropriate cross-section engaged between said confronting grooves.

In a construction of this kind disclosed in German specification No. 25 11 278 the bead edge portion entering the recess or groove in the structural member is provided with approximately parallel upper and lower surfaces so that after the bead edge portion has been pressed-in transversely to the longitudinal direction of the joint the side of the bead edge portion which is then at the rear against the corresponding face of the structural member is spaced at a greater distance from the front edge of the structural member; this large spacing is necessary because otherwise there is a danger that the bead edge portion might be able to detach from its bed in the structural member in the event of severe stress being applied around the fastening key: quite apart from this the bead edge portion has to be made relatively massive because of the requirement specified above, which involves a lot of material.

SUMMARY OF THE INVENTION

It is an object of the present invention to improve the bedding or anchorage of the bead edge portion in a joint-spanning means of the type set forth above and as a consequence to save material as far as possible in the area of the bead edge portion. This object is met in the present invention by providing the bead portion with a down-turned tongue for engagement behind a nose, upstanding in the recess in the corresponding adjoining part, in response to a rocking motion of said bead portion to effect such engagement.

Because of this arrangement it is not only possible to loosely insert the bead edge portion before it is pressed into its snapped-in position and then push-in the fastening key, before it is introduced into the structural member, but the rocking motion can take place for the first time during the introduction of the bead edge portion. The action of pressing the bead edge portion into the structural member is thus substantially easier, can be effected from above and no longer has to take place over the complete height of the head portion.

German specification No. 29 52 613 discloses a bead edge which is embedded mirror-image fashion at its two sides into its operative position, but this bead edge is brought into the effective position by a spreading action; also it does not involve any rounded or approximately rounded fastening key.

German specification No. 26 09 759 also discloses a joint-spanning construction in which there is embedding of the bead edge in a recess opposite the fastening key, but the safety of this joint-spanning construction is exclusively dependent on the elasticity of the bead edge because the fastening body in its effective position is not fittedly engaged in a recess in the structural member nor in any such arrangement in the bead edge.

In accordance with a preferred embodiment of the invention the bead edge portion may, as is known per se, be provided with a longitudinal cavity which reduces the solid cross-sectional volume thereof. On the other hand it is possible for the first time for the bead edge according to the invention to be made substantially incompressible.

Because the pressing-in of the bead edge portion is effected by rocking the latter snapping-in of the fastening key and with it the bead edge can take place without any bending, even if, in accordance with a modified embodiment of the invention, in certain circumstances a very slight bending of the bead edge is provided for in an area away from the fastening key.

In accordance with a further embodiment of the invention the nose is convex with a part-circular-section rolling face.

In supplementation of the embodiment noted above, or even, in the case of an independent further embodiment, the cavity defined behind said nose in the parent recess is of greater width than the nose itself. The result achieved here is that the lower bearing face of the bead edge portion can be displaceable during insertion of the latter during the rocking.

Advantageously the lateral bearing face of the bead edge portion against the structural member is convex; this is preferred but is not always the case if—as noted above—the lower face of the bead edge portion is displaced. It is also possible to provide for the lateral bearing face of the bead edge to be curved from the groove for the fastening key to the tongue.

In particular in the case where a reduction in cross-section is provided in known fashion by a cavity the bead edge may be made with different softening agents, i.e. with parts of contrasted hardness.

DESCRIPTION OF THE DRAWINGS

Embodiments of the invention are illustrated by way of example in the drawings: each figure shows the engagement at one side edge of a junction-spanning means according to one embodiment of the invention. In these drawings:

FIG. 1 one embodiment of the invention partly in longitudinal section,

FIG. 2 shows a modified embodiment partly in longitudinal section,

FIGS. 3 and 4 illustrate a third embodiment partly in longitudinal section and in two positions, and FIGS. 5 and 6 show a fourth embodiment partly in longitudinal section and again in two positions.

DETAILED DESCRIPTION OF THE DRAWINGS

Referring first to FIG. 1, this illustrates a profiled steel girder 1 of a bridge, this girder having therein a recess 2 extending in the longitudinal direction of the joint with the adjacent member of the bridge structure and adapted to receive the edge bead portion 3 of a gap-closing body 4 in a first embodiment.

It will be apparent, in the case of a mirror-image or similar profiled girder construction the latter may be two-sided, that is to say may support a gap-bridging body at each side thereof.

The recess 2 is in the form of a groove running longitudinally of the joint, being defined between an upper branch of at, say, the road level of the bridge, and a lower branch 6. Upstanding from the latter is a convex, bellied projection 7 the function of which will be explained below. The projection 7 may for example be provided by welding a round rod to a flat branch 6 and forms a rounded surface on which the bead edge can roll.

In the embodiment illustrated in FIG. 1 the bead portion 3 has two substantially parallel lateral faces 8 and 9 which in the working position are at an angle of about 60 degrees (or 30 degrees=to the vertical.

The face 10 of the bead portion at the top and parallel to the roadway is approximately flat and exhibits a half-round groove 11 for receiving a circular-section fastening key 12 of steel or plastic material. A confronting groove 13 to complete the housing for the key and of substantially the same cross-section is provided in the branch 5.

The bead edge portion 3 has a crescent-moon-section cavity extending continuously in the longitudinal direction of the bead edge 3 this representing a reduction of the solidness of the bead and allowing for resilient constriction of the relevant part of the bead edge necessary to cater for snapping of the fastening key 12 into the groove 11–13.

To insert or bring in the bead edge portion 3 and/or the mirror-image bead edge portion at the other side (not shown=of the body 4, the bead 3 is first placed on the projection 7, whereafter the fastening key is inserted in the groove 11 and, in the embodiment of FIG. 1, the bead edge 3 is rocked to the left. As can be seen from FIG. 1 the "corner" 15 of the bead 3 is rounded to facilitate its pressing to the left about the point 16 during this rocking movement.

In the embodiment of FIG. 2 the structural girder 21 has a recess or groove 22 into which a bead 23 having a cavity 24 can be rocked. Even in this embodiment the fastening key 25 is mounted in confronting semi-round grooves 26 and 27 to hold the bead edge portion in working position. The bead 23 in this embodiment is provided at the outer end thereof with a rounded tip 28 which engages behind the bellied projection 29 of the girder 21. In this embodiment the tip 28 is first introduced into the section 30 of the recess, the fastening key 25 is then placed in the groove 27, and finally the body 23 of the bead portion is rocked to the left into the position illustrated in FIG. 2. In this embodiment the body 23 of the bead portion is made resilient at least in the region below the groove 27 so that when the bead is pushed-in material of the bead portion is urged into the cavity 24 to bring the key 25 beneath the edge of the girder profile.

In the embodiment illustrated in FIGS. 3 and 4, in contrast to the cases previously described the bead portion 30 is substantially incompressible and there is thus no reduction in the cross-sectional volume when pressure is exerted on the material.

The structural girder 31 in this embodiment is shown with a longitudinal groove or recess 34 for reception of the bead portion 30 and, in this recess, with a convex bellied nose projection 32 upstanding from its bottom edge which is also provided with two side-by-side curved cavities 35 and 41 behind the nose 32. Each of these cavities is designed to accommodate a tongue-forming tip 33 at the end of the bead portion 30.

When the bead portion is inserted in recess 34 the tip 33 enters cavity 35 to be lodged therein (see FIG. 5) allowing the upper edge of the bead portion to assume a depressed situation opposite the underside 37 of the upper limb of the girder and enabling the fastening key 38 to slide over or past this underside when pressure is applied to the bead portion in the direction of arrow 39.

After being pressed in this direction 39 the tightening key 30 snaps into the recess 40 in girder 31 so that the tongue 33 slips from cavity 35 into cavity 41 (see FIG. 3) and this because it rolls on the rounded surface 42 of the recess 34.

The embodiment illustrated in FIGS. 5 and 6 also starts from a bead portion 50 entering a recess in the girder but itself of resilient character and, as further indicated below, deformable. The recess 51 in the girder 52 has a concave curved part 53 and the previously-described recess 54 for accommodating the key 55.

Again in this emodiment a rounded projection or nose 56 is provided, and in this instance the bead portion end 58 is given a concave rolling surface 57 which can be rocked in this nose. The rocking takes place in the direction of arrow 59 until the parts achieve the end position shown in FIG. 5.

As can be seen from FIGS. 5 and 6 the inner surface 60 of the bead portion 50 is of markedly concave form below the key 55 so that there is a certain amount of springiness in the bead portion 50, which is substantially incompressible per se, in the area 61.

As already mentioned above the bead edge may incorporate softening agents of differing effect so that various sections of the bead edge can be softer or harder and above all the parts which come in contact with the girder edge may be non-resilient.

I claim:

1. In the combination of bridge structural members or the like and resilient joint spanning bodies, the improvement comprising:

(a) a structural member longitudinal edge having a recess between an upper and lower projection, said lower projection being formed into an upwardly facing semicircular lip spaced away from said recess, and shaped to form a smooth and continuous curved surface over said semicircular lip and into said recess, and said upper projection having a semicircular groove downwardly facing;

(b) a resilient joint spanning body having a rounded projection for slidable engagement into said recess over said semicircular lip, and having a semicircular cavity adjacent said rounded projection, said projection and said cavity together shaped to form a smooth and continuous curved surface, which surface is substantially complementary to said curved surface over said semicircular lip and into said recess, thereby to form mating smooth surfaces to facilitate slidable engagement between said joint spanning body and said structural member; said joint spanning body further having an upwardly facing semicircular groove in confronting relationship to said structural member downwardly facing semicircular groove when said joint spanning body is fully slidably engaged with said structural member; and (c) a fastening key in said confronting semicircular grooves.

2. The combination of claim 1, further comprising a longitudinal cavity in said joint spanning body.

3. The combination of claim 1, wherein said fastening key further comprises a substantially incompressible material.

4. The combination of claim 1, further comprising a void between said rounded projection of said joint spanning body and said structural member.

* * * * *